US008876574B2

(12) United States Patent
Bourdelaise et al.

(10) Patent No.: US 8,876,574 B2
(45) Date of Patent: Nov. 4, 2014

(54) DEVICE FOR SCATTERING CONFETTI

(75) Inventors: Chase Bourdelaise, New York, NY (US); Paul Wagner, Locust Valley, NY (US)

(73) Assignee: FiestaFive, LLC, Gambrills, MD (US)

( * ) Notice: Subject to any disclaimer, the term of this patent is extended or adjusted under 35 U.S.C. 154(b) by 440 days.

(21) Appl. No.: 13/114,723

(22) Filed: May 24, 2011

(65) Prior Publication Data

US 2011/0290912 A1 Dec. 1, 2011

Related U.S. Application Data

(60) Provisional application No. 61/348,175, filed on May 25, 2010.

(51) Int. Cl.
*A63H 33/30* (2006.01)
*A63H 37/00* (2006.01)

(52) U.S. Cl.
CPC ..... *A63H 37/00* (2013.01)
USPC ..... 446/475; 446/399; 446/406

(58) Field of Classification Search
USPC ..... 446/399, 406, 475
See application file for complete search history.

(56) References Cited

U.S. PATENT DOCUMENTS

| | | | | | |
|---|---|---|---|---|---|
| 825,843 | A | | 7/1906 | Kliemandt | |
| 1,324,092 | A | * | 12/1919 | Worswick | 446/398 |
| 1,664,401 | A | * | 4/1928 | Alfred | 446/475 |
| 2,179,662 | A | * | 11/1939 | Langos | 446/182 |
| 2,752,729 | A | * | 7/1956 | Macinnes | 446/399 |
| 3,610,152 | A | * | 10/1971 | Kaneko | 102/355 |
| 3,721,041 | A | * | 3/1973 | Goldfarb | 446/169 |
| 3,744,417 | A | * | 7/1973 | Kaneko | 102/357 |
| 3,908,306 | A | * | 9/1975 | Petersen et al. | 446/52 |
| 4,037,790 | A | * | 7/1977 | Reiser et al. | 239/529 |
| 4,059,917 | A | * | 11/1977 | Sims et al. | 446/398 |
| 4,216,609 | A | * | 8/1980 | Ortiz | 446/401 |
| 4,463,879 | A | * | 8/1984 | Des Voignes | 222/175 |
| 4,605,230 | A | * | 8/1986 | Halford et al. | 273/129 AP |
| 5,072,856 | A | * | 12/1991 | Kimble | 222/78 |
| 5,109,773 | A | * | 5/1992 | Kaneko | 102/357 |
| 5,141,467 | A | * | 8/1992 | Crosbie | 446/398 |
| 5,303,847 | A | * | 4/1994 | Cottone | 222/78 |
| 5,338,242 | A | | 8/1994 | Cheng | |
| 5,354,227 | A | * | 10/1994 | Watkins | 446/475 |
| 5,403,225 | A | | 4/1995 | Watkins | |
| 5,433,644 | A | * | 7/1995 | Cheng | 446/224 |
| 5,468,170 | A | * | 11/1995 | Kantor et al. | 446/23 |
| 5,484,085 | A | * | 1/1996 | Bennett | 222/175 |
| 5,624,295 | A | | 4/1997 | Watkins | |
| 5,634,840 | A | * | 6/1997 | Watkins | 446/475 |
| 5,678,730 | A | * | 10/1997 | Fabek et al. | 222/78 |
| 5,772,491 | A | | 6/1998 | Watkins | |
| 5,823,850 | A | | 10/1998 | Watkins | |
| 5,961,003 | A | * | 10/1999 | Coryell | 222/175 |
| 5,971,240 | A | * | 10/1999 | Dequaine | 224/217 |

(Continued)

*Primary Examiner* — Gene Kim
*Assistant Examiner* — Joseph B Baldori
(74) *Attorney, Agent, or Firm* — Maier & Maier, PLLC

(57) ABSTRACT

A device for scattering confetti. The device may include a body, a container, coupled to the body, and having confetti disposed therein, and at least one retaining structure for maintaining the device in a hand of a person. A portion of the body may be disposed in the palm of the hand, while one or both of the body and the container may further include at least one component for releasing confetti from the container.

13 Claims, 9 Drawing Sheets

(56) References Cited

U.S. PATENT DOCUMENTS

| | | | | |
|---|---|---|---|---|
| 6,299,502 | B1 | 10/2001 | Cheng | |
| RE37,616 | E * | 4/2002 | Schumacher | 124/66 |
| 6,421,502 | B1 * | 7/2002 | Aronie et al. | 392/399 |
| 6,447,364 | B1 * | 9/2002 | Song | 446/475 |
| 6,450,160 | B1 | 9/2002 | Fu | |
| 6,572,435 | B1 | 6/2003 | Wong | |
| 6,814,260 | B2 * | 11/2004 | Caffrey | 222/175 |
| 6,826,355 | B2 * | 11/2004 | Aronie et al. | 392/399 |
| 7,574,973 | B2 * | 8/2009 | Markham | 116/209 |
| 7,666,056 | B2 * | 2/2010 | Munoz et al. | 446/475 |
| 7,731,061 | B1 * | 6/2010 | Woodhouse et al. | 222/175 |
| 2001/0053654 | A1 | 12/2001 | Watkins | |
| 2002/0077027 | A1 * | 6/2002 | Wu | 446/475 |
| 2005/0075043 | A1 * | 4/2005 | Lorenzana | 446/475 |
| 2005/0202753 | A1 * | 9/2005 | Munoz et al. | 446/475 |
| 2006/0213106 | A1 | 9/2006 | Young | |
| 2008/0311822 | A1 * | 12/2008 | Kim | 446/475 |

* cited by examiner

DEVICE FOR SCATTERING CONFETTI

CROSS-REFERENCE TO RELATED APPLICATIONS

This application claims priority to U.S. Provisional Patent Application No. 61/348,175, filed May 25, 2010 and entitled DEVICE FOR SCATTERING CONFETTI, the entire contents of which are hereby incorporated by reference.

BACKGROUND

Confetti is widely used during parades, celebrations, weddings, sports events and other joyful occasions to enhance the celebratory ambiance of the event. The confetti is typically scattered by hand or dispersed by shaking containers. This requires that a person's hands be occupied with scattering confetti and can detract from the person's participation in celebratory gestures, embraces, and other expressions of happiness.

For example, one well-known gesture used to express celebration, congratulations, or success is the "high-five" gesture, wherein two people, with hands stretched above their heads, join the palms of their hands together. The palms are typically joined with force, resulting in a clapping sound. However, an individual who has confetti in the hands may not be able to participate in such a gesture without losing the confetti, and an individual participating in the gesture may not be able to simultaneously scatter confetti.

As confetti can enhance the celebratory feeling of any gesture, even the "high-five," a solution for scattering confetti while performing gestures is desired.

SUMMARY

According to at least one exemplary embodiment, a device for scattering confetti may be disclosed. The device may include a body, a container, coupled to the body, and having confetti disposed therein, and at least one retaining structure for maintaining the device in a hand of a person. A portion of the body may be disposed in the palm of the hand, while one or both of the body and the container may further include at least one component for releasing confetti from the container.

According to another exemplary embodiment, a device for scattering confetti may be disclosed. The device can include a body, a cavity defined within the body, and having a proximal end and a distal end, a piston disposed in the cavity and moveable between the proximal end of the cavity and the distal end of the cavity, a container removably coupled to the body and having confetti disposed therein, a detonative charge, disposed between the piston and the confetti, and at least one retaining structure for maintaining the device in a hand of a person. The device can further include a trigger, wherein a movement of the trigger results in a movement of the piston. The movement of the piston can result in the detonation of the charge.

According to another exemplary embodiment, a hand apparel for use with a device for scattering confetti may be disclosed. The hand apparel can include a pocket disposed on the hand apparel such that the pocket is disposed proximate to the palm of a hand, wherein the pocket is adapted to receive a portion of the device for spreading confetti. The hand apparel may be a glove or may be a band encircling the hand substantially above the thumb and below the fingers.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
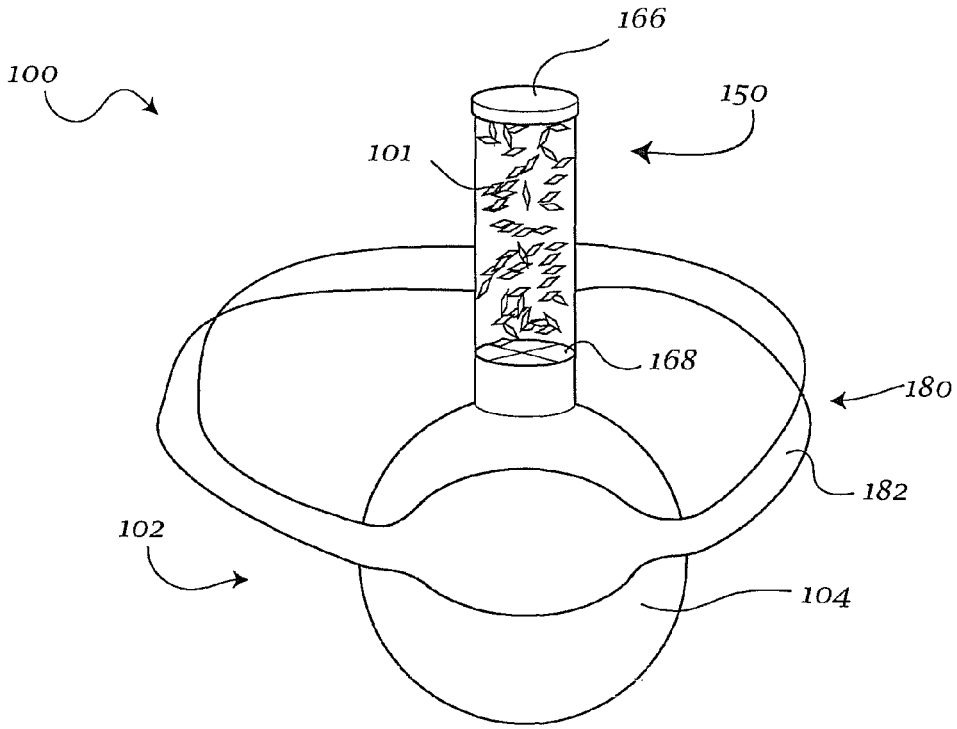
FIGS. 1*a*-1*e* show a first exemplary embodiment of a device for scattering confetti.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Referring generally to FIGS. 1*a*-10*e*, a device for scattering confetti may be disclosed. The device for scattering confetti may be configured to fit in the palm of a user and may include at least one structure for comfortably retaining the device within the palm of the user. The retaining structures may extend around the hand, wrist, or fingers of the user. The device may include a body and a container wherein confetti may be stored. The body may further include an extension. At least one component for ejecting confetti may be disposed in the body, the extension, the container, or any combination of the body, the extension and the container.

The retaining structures of the device for scattering confetti may include, but are not limited to, straps, finger rests, palm rests, clips, or any other retaining structures that enable the device to function as disclosed herein. In some embodiments, the retaining structures may be configured such that a portion of the device can be disposed between the middle and ring fingers of the hand. In some embodiments, the retaining structures may be coupled to the body of the device or may be formed integral with the body. The device may further be adapted to be attached to a glove or a sleeve, and the glove and sleeve may in turn be adapted to be attached to the confetti scattering device.

At least one component for ejecting confetti of the device may include, but is not limited to, an air bladder, a spring release, and a string pulley. The air bladder may be resiliently deformable, and may contain a sufficient quantity of air to generate a positive air pressure force for expelling confetti from the container. The positive air pressure generated by expulsion of air from the bladder may directly act on the confetti so as to expel it from the container. Alternatively, the positive air pressure may expel a bag or pouch from the container, where the pouch contains confetti and is turned inside out by the air pressure force, thereby expelling the confetti. The positive air pressure may also release a spring, which can then act on the confetti so as to release it from the container. The positive air pressure may also act on a piston, which may have a pin, which can then set off a detonative charge that can generate additional positive air pressure to release confetti from the container. The charge may be disposed external or internal to the confetti container and may be disposed between the piston and the confetti. The piston may alternatively release a spring that can then release the confetti from the container. Alternatively, the piston or spring may trigger a secondary spring disposed internal to the confetti container, which then can then act to release the confetti from the container.

The spring release triggering mechanism may include a trigger, which may be, but is not limited to, a button, a lever, or any other trigger that allows the device for scattering confetti to function as disclosed herein. The trigger can then act on a spring, which can then act on the confetti so as to release it from the container. Alternatively, the trigger can act on a spring, which can then set off a detonative charge that can release confetti from the container. The spring may need to be reset after being activated, and the confetti scattering device may include structures for resetting the spring. Additional resilient members may be provided so as to return the trigger to an initial position after being activated. The trigger or the spring may also act on a piston, which may have a pin, which can then set off a detonative charge that can generate additional positive air pressure to release confetti from the container. The charge may be disposed external or internal to the confetti container and may be disposed between the piston and the confetti.

The string pulley triggering mechanism may include a string, cord, strap, loop or any other member that may be pulled and that allows the device for scattering confetti to function as disclosed herein. The string pulley can then act on a spring, which can then act on the confetti so as to release it from the container. Alternatively, the string pulley can act on a spring, which can then set off a detonative charge that can release confetti from the container.

The container where the confetti may be stored may be integral to the device for scattering confetti or may be removably coupled to the device. A proximal end of the container may be adapted for coupling to the confetti scattering device. The confetti may be stored within a cavity in the container, and the container may be reloadable or may be configured for single use. The container may include a first aperture at a distal end thereof, through which aperture the confetti may be released. The container may further include a second aperture at the proximal end thereof, through which aperture an air pressure force may enter the container so as to exert pressure upon and to release the confetti.

In some embodiments, at least one component for ejecting confetti may be disposed within the container. For example, the container may further include a bag or pouch wherein the confetti may be stored. The bag or pouch may be adapted to release the confetti, for example, by turning inside out, when a force acts upon the bag. The bag may further be adapted for repeated use.

The detonative charge may include, but is not limited to, a percussion cap such as that used for cap guns, a cartridge containing a propellant gas such as $CO_2$, a propellant powder, or impact-sensitive silver fulminate (AgONC). Furthermore, the charge may include a composition that is compliant with United Nations Organization Hazard Class and Division code 1.4S, or any corresponding or equivalent national hazardous material classifications.

When the body of the device is disposed in the palm of the user, the body and container may be oriented such that a portion of the body and a portion of the container are disposed between the middle and ring fingers of the hand, and such that a portion of the container is proximate the back side of the hand. Furthermore, the container may be oriented such that, when the fingers of the hand are extended, an acute angle is formed between the tips of the fingers and the distal end of the container. Other orientations for the container may be contemplated and provided as desired, for example, but not limited to, a portion of the container being oriented parallel to the fingers, a portion of the container being disposed on the inside of the hand or the fingers, a portion of the container being oriented perpendicular to the fingers, or the container having a forked configuration with a plurality of distal ends having apertures through which the confetti may be released.

Figure 1B:
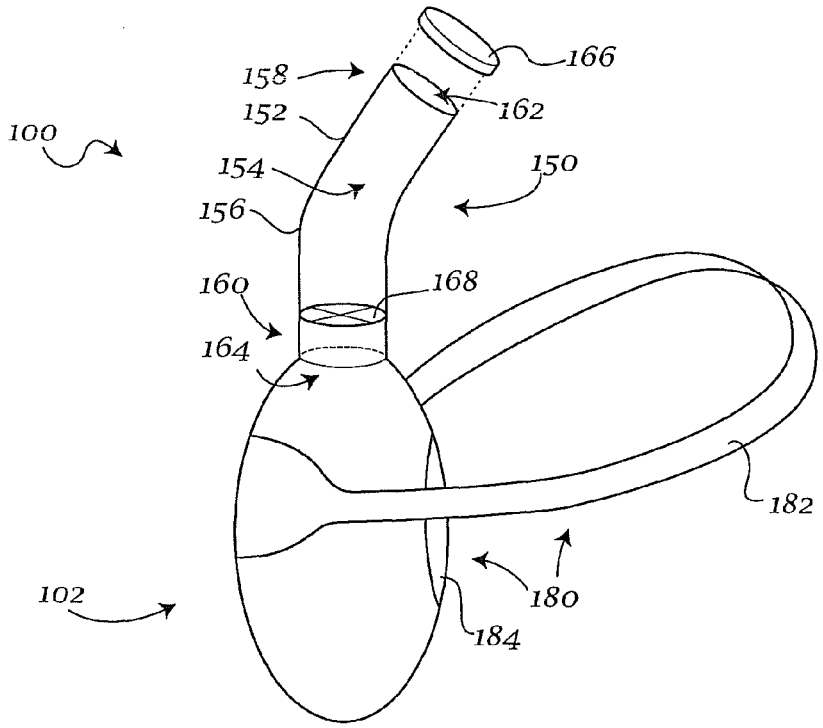

FIGS. 1*a*-1*b* show an exemplary embodiment of a device for scattering confetti 100. This embodiment of device 100 may be adapted for single use, or may be manually reloaded by the user. Device 100 may include a body 102, a retaining structure 180, and a confetti container 150 having confetti 101 therein. In the exemplary embodiment, body 102 may include an air bladder 104, and container 150 may be integral with body 102. Body 102 may have a spherical shape, an ellipsoid shape, or any other desired shape that enables device 100 to function as described herein.

Air bladder 104 may be formed such that it is resiliently deformable under application of pressure. To that end, air bladder 104 may be formed from a variety of materials, such as, for example, rubber, latex, polyethylene, or any desired material that enables device 100 to function as described herein. Air bladder 104 may further include reinforcing structures. The volume of air bladder 104 can be sufficient to expel confetti 101 from container 150. In some embodiments, air bladder 104 may have a length and height of approximately 4.45 cm (1.75 in) and a width of 2.5 cm (1.0 in), although these dimensions are exemplary and should not be considered limiting.

Retaining structure 180 may be, for example, a strap 182, and may be coupled to body 102. Strap 182 may have a length sufficient to extend around the hand of the user, may have an adjustable length. Strap 182 may include a fastener, for example a hook-and-loop fastener, snap fastener, a button fastener, or any other fastener known in the art. Strap 182 may further be elastic. Alternatively, retaining structure 180 may be an adhesive 184 for attaching body 102 to the palm of the user's hand, or may be a glove having device 100 disposed therein such that body 102 is disposed in the palm of the user's hand when the glove is worn. The glove may be formed from any desired material, including, but not limited to, nylon, spandex, lycra, leather, synthetic leather, and the like.

Container 150 may have an elongated shape, an outer wall 152 enclosing a cavity 154, and may include a bend 156 in a portion of its length. Container 150 may further have a circular cross-section, an elliptical cross-section, or any desired cross-section that enables device 100 to function as described herein. Container 150 may include a distal end 158 and a proximal end 160, with first aperture 162 defined in distal end 158, and second aperture 164 being defined in proximal end 160. Confetti 101 may be disposed in cavity 154 between the distal and proximal ends of the container. To retain the confetti within container 150, a cap 166 may be removably coupled to container 150 proximate first aperture 158, and a one-way valve 168 may be disposed proximate second aperture 164. Upon application of positive air pressure from air bladder 104, valve 168 may open and cap 166 may decouple from container 150, allowing confetti 101 to be released.

In some embodiments, container 150 may have a length of approximately 5.1-7.6 mm (2.0-3.0 in) and a diameter of 1.0 cm (0.39 in), although these dimensions are exemplary, should not be considered limiting, and may vary depending on the desired amount of confetti 101 to be stored within container 150. Valve 168 may be formed, for example, from a resilient material having cross-slits defined therein, may be formed from a paper or tissue material that is adapted to rupture under application of positive air pressure from air bladder 104, or any other desired material that enables device 100 to function as described herein. Cap 166 may be removably coupled to container 150 such that it is easily decouplable therefrom under application of positive air pressure from air bladder 104. Cap 166 may be formed from paper, cardboard, tissue material, foam, or any other desired material that enables device 100 to function as described herein.

Figure 1C:
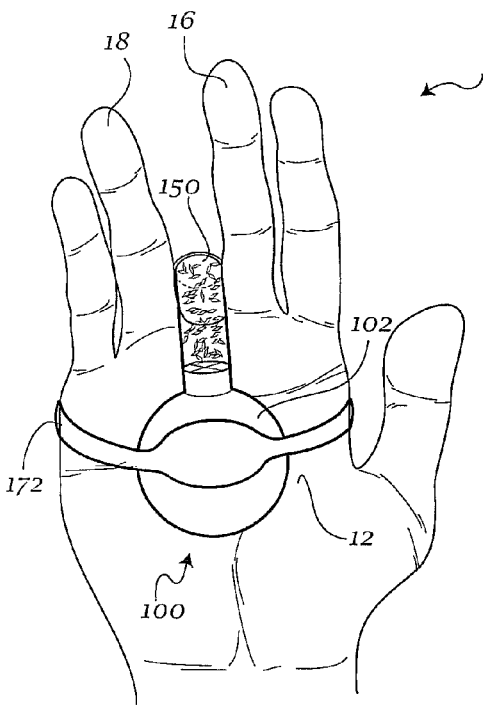
Figure 1D:
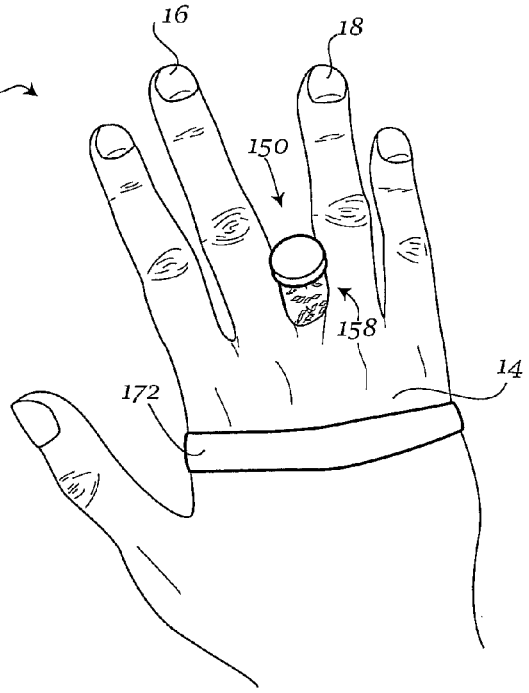

FIGS. 1*c*-1*d* show an exemplary embodiment of confetti scattering device 100 attached to a user's hand 10. Body 102 of device 100 may be disposed in the palm 12 of the hand, with strap 172 extending around the backside 14 of the hand 10. Alternatively, an adhesive may be disposed on body 102 and coupled to the palm 12. Container 150 of device 100 may extend between the middle finger 16 and ring finger 18 of hand 10. The angle of container 150 may be such that when device 100 is attached to a user's hand and the user's fingers are fully extended, an acute angle can exist between distal end 158 and the tips of the fingers. The angle of container 150 facilitates directing the confetti 101 upward and rearward in relation to the user's hand when the user's hand is in a substantially vertical orientation, such as, for example, the orientation typically used for a "high five" gesture.

Figure 1E:
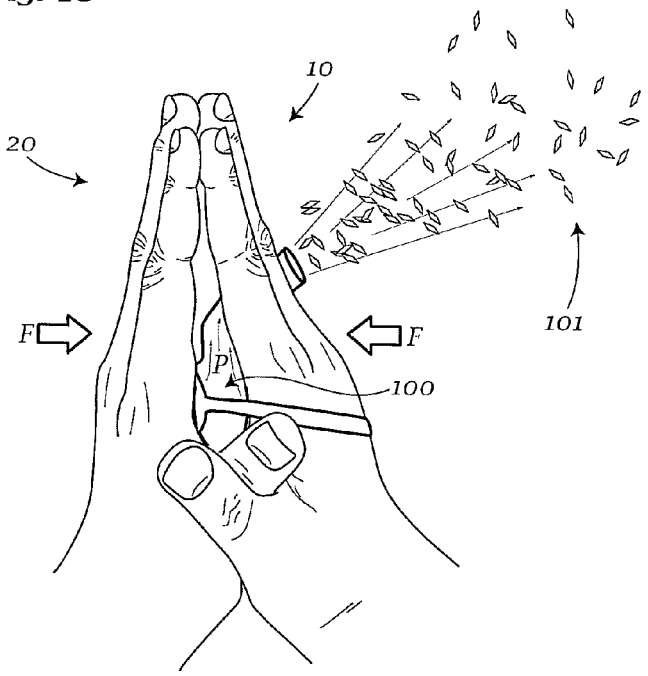

FIG. 1*e* shows an exemplary embodiment of confetti scattering device 100 in operation during a "high five" gesture. The collision between hand 10 having device 100 attached thereto, and a second hand 20 exerts pressure F on air bladder 104 of body 102, thereby directing positive air pressure P through second aperture 164, container 150, and first aperture 162. The confetti 101 is thus ejected from container 100 in a substantially upward and backward direction with relation to hand 10.

Figure 2B:
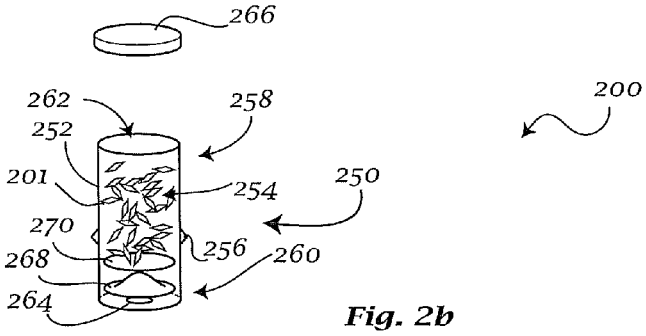
FIGS. 2*a*-2*c* show a second exemplary embodiment of a device for scattering confetti.
Figure 2A:
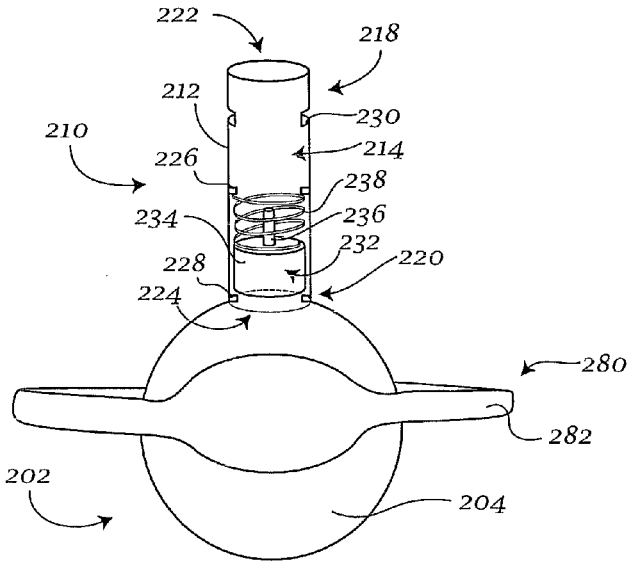
Figure 2C:
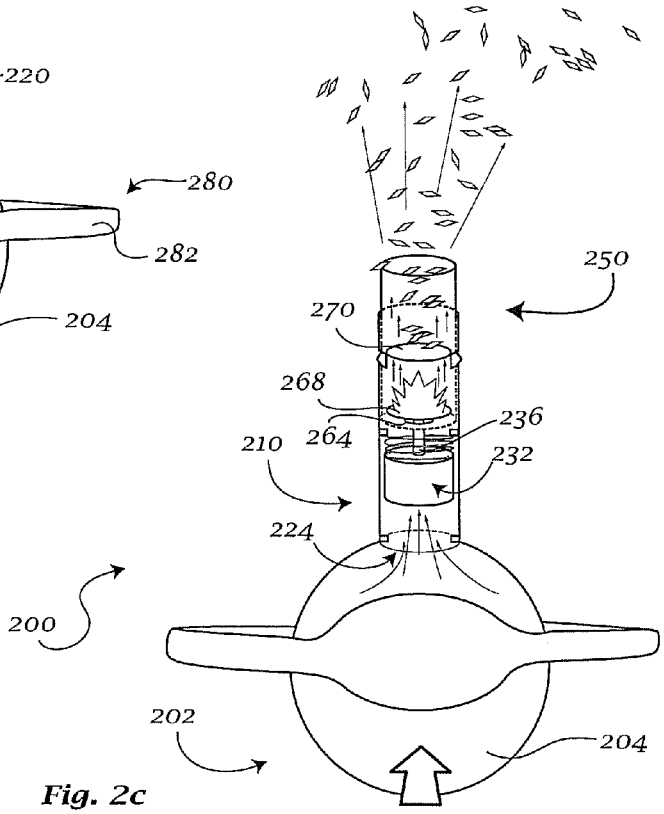
Figure 3A:
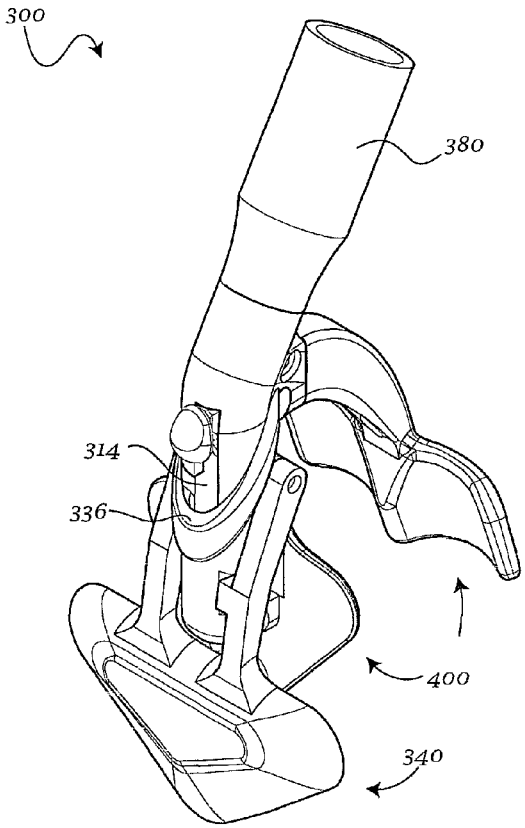
FIGS. 3*a*-3*d* show a third exemplary embodiment of a device for scattering confetti.
Figure 3B:
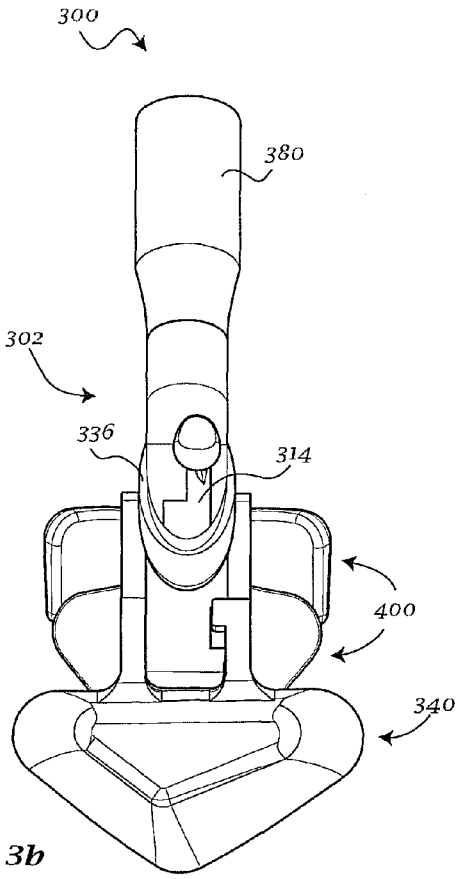
Figure 3C:
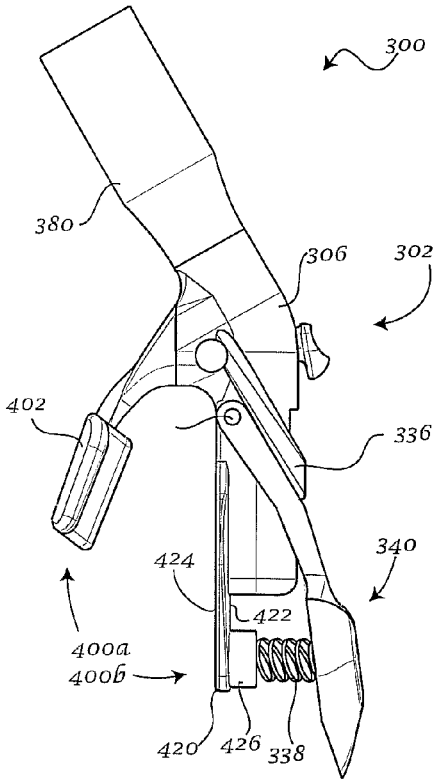
Figure 3D:
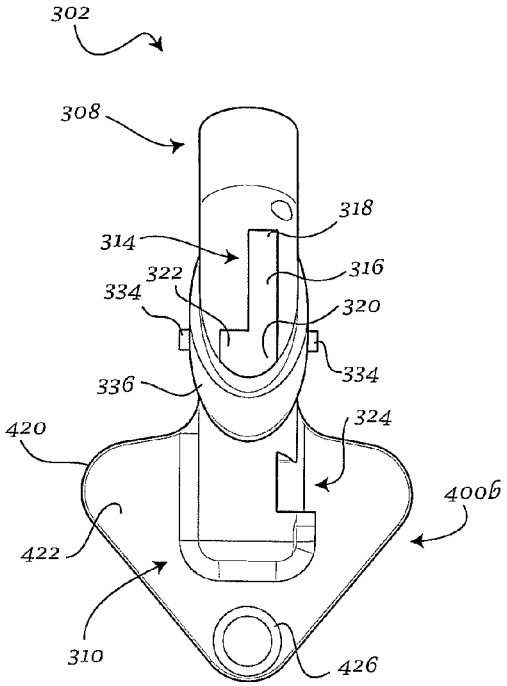

FIGS. 2*a*-2*c* show another exemplary embodiment of a device for scattering confetti 200. This embodiment of device 200 may be adapted for repeated uses via a replaceable container. Device 200 may include a body 202, a retaining structure 280, and a confetti container 250 having confetti 201 therein. In the exemplary embodiment, container 250 may be removably coupled to body 202, while body 202 may include an air bladder 204 and an extension 210. Body 202 may have a spherical shape, an ellipsoid shape, or any other desired shape that enables device 200 to function as described herein.

Air bladder 204 may be formed such that it is resiliently deformable under application of pressure substantially similar to the force exerted in a "high-five" gesture. To that end, air bladder 204 may be formed from a variety of materials, such as, for example, rubber, latex, polyethylene, or any desired material that enables device 200 to function as described herein. Air bladder 204 may further include reinforcing structures. The volume of air bladder 204 can be sufficient to expel confetti 201 from container 250. In some embodiments, air bladder 204 may have a length and height of approximately 4.45 cm (1.75 in) and a width of 2.5 cm (1.0 in), although these dimensions are exemplary and should not be considered limiting.

Retaining structure 280 may be a strap 282, and may be coupled to body 200. Strap 282 may have a length sufficient to extend around the hand of the user, may have an adjustable length. Strap 282 may include a fastener, snap fastener, a button fastener, or any other fastener known in the art. Strap 182 may further be elastic. Alternatively, retaining structure 280 may be an adhesive for attaching body 202 to the palm of the user's hand, or may be a glove having device 200 disposed therein such that body 202 is disposed in the palm of the user's hand when the glove is worn. The glove may be formed from any desired material, including, but not limited to, nylon, spandex, lycra, leather, synthetic leather, and the like.

Extension 210 may have an elongated shape and an outer wall 212 enclosing a cavity 214. Extension 210 may further have a circular cross-section, an elliptical cross-section, or any desired cross-section that enables device 210 to function as described herein. Extension 210 may include a distal end 218 and a proximal end 220, with first aperture 222 defined in distal end 218, and second aperture 224 being defined in proximal end 220 such that cavity 214 is in fluid communication with air bladder 204. Extension 210 may include a first protrusion 226 extending into cavity 214 and disposed between first aperture 222 and second aperture 224, and a second protrusion 228 extending into cavity 214 and disposed between first protrusion 228 and second aperture 224. Protrusions 228 may be tabs, lips, or any other desired structures extending into cavity 214 of extension 210. Protrusions 228 may be formed integral with extension 210. Extension 210 may further include cutouts 230 defined in outer wall 212 and disposed between first protrusion 226 and first aperture 222.

In some embodiments, extension 210 may have a length of approximately 5.1-7.6 mm (2.0-3.0 in) and a diameter of 1.0 cm (0.39 in), although these dimensions are exemplary, should not be considered limiting, and may vary.

Disposed within cavity 214 and between first and second protrusions 226, 228 may be a piston 232. Piston 232 may include a base portion 234 and a pin 236 disposed on a distal end of the base portion. Base portion 234 may have a diameter less than the diameter of cavity 214 but greater than the diameter between protrusions 226, 228. The piston can thus be able to move within extension 214 without friction against wall 212, while the protrusions 226, 228 can limit the movement of piston 232 to between an initial position proximate second protrusion 228 and a final position proximate first protrusion 226. Furthermore, the diameter of base portion 234 may be such so as to reduce the likelihood of piston 232 tilting or becoming dislodged within extension 210. Upon application of positive air pressure from air bladder 204, piston 232 may be moved from the initial position to the final position, and upon removal of positive air pressure from air bladder 204, piston 232 may retreat to the initial position.

Disposed between piston 232 and first protrusion 226 may be a resilient member, such as a spring 238. Spring 238 may have a diameter less than the diameter of cavity 214 but greater than the diameter between protrusions 226, 228. Spring 238 can facilitate moving piston 232 from the final position to the initial position after the removal of positive air pressure from air bladder 204. Spring 238 may be a light tension spring, and may be formed, as a non-limiting example, from plastic, metal, or any other desired material. Alternatively, any resilient member that enables device 200 to function as disclosed herein may be used in place of spring 238.

Turning to FIG. 2*b*, container 250 may have an elongated shape, and an outer wall 252 enclosing a cavity 254. Container 250 may include a distal end 258 and a proximal end 260, with first aperture 262 defined in distal end 258, and second aperture 264 defined in proximal end 260. The diameter of second aperture 264 may be slightly greater than the diameter of pin 236, such that pin 236 may be received therein. Confetti 201 may be disposed within cavity 254 of container 250. To retain the confetti within container 250, a cap 266 may be removably coupled to container 250 proximate first aperture 262. Cap 266 may be formed from paper, cardboard, tissue material, foam, or any other desired material that enables device 200 to function as described herein. Additionally, disposed on the exterior of wall 252 may be protruding clips 256, which may be resilient and which may be positioned and sized to be received within cutouts 230 of extension 210. However, it should be appreciated that container 250 may be retained within extension 210 without the use of clips 256 and cutouts 230, for example, by friction fit, snap fit, threads, or any other desired retention that enables device 200 to function as described herein.

The diameter of container 250 may be slightly less than the diameter of cavity 214 such that container 250 can be slid into cavity 214 and fit snugly therein. Container 250 may further have a cross-section substantially similar to the cross-section of extension 210. The length of container 250 may vary depending on the desired amount of confetti 201 to be stored within container 250. However, the distance between distal end 258 of container 250 and clips 256 may be greater than the distance between distal end 218 of extension 210 and cutouts 230 of extension 210. This can provide a portion of container 250 that may be gripped by the user, in order, for example, to withdraw container 250 from extension 210. Furthermore, when container 250 is disposed within extension 210, the proximal end 260 of container 250 may be positioned such that a portion of pin 236 can penetrate second aperture 264.

Container 250 may further include a detonative charge 268 and a separator 270 within cavity 254. Charge 268 may be disposed substantially proximate proximal end 220 such that charge 268 is between piston 232 and confetti 201, while separator 270 may be disposed between charge 268 and confetti 201. Separator 270 can reduce the likelihood of confetti 201 igniting upon combustion of charge 268 and can further facilitate expelling confetti 201 from container 250. Charge 268 may be, but is not limited to, a percussion cap such as that used for cap guns, a cartridge containing a propellant gas such as $CO_2$, a propellant powder, or impact-sensitive silver fulminate (AgONC). Furthermore, the charge may include a composition that is compliant with United Nations Organization Hazard Class and Division code 1.4S, or any corresponding or equivalent national hazardous material classifications. Separator 270 may have a planar shape substantially similar to the cross-section of formed from a lightweight, tough material that can withstand the explosive force of charge 268 without breaking. As a non-limiting example, such materials may include cardboard, heavy paper, plastic, foam, or any other desired material that enables device 200 to function as described herein.

FIG. 2*c* shows an exemplary embodiment of confetti scattering device 200 in operation. As pressure F is exerted on air bladder 204, positive air pressure $P_1$ is directed through second aperture 224 of extension 210. The positive air pressure $P_1$ can force piston 232 with pin 236 from the initial position to the final position. As it approaches the final position, pin 236 is directed through second aperture 264 of container 150, so as to strike charge 268, thereby igniting the charge. A major proportion of the positive air pressure $P_2$ generated by the ignition of charge 268 can be directed toward separator 270, confetti 201 and cap 266. Cap 266 can thus decouple from first aperture 262 of container 250 and the confetti can be ejected through first aperture 262. Additionally, a minor proportion of the positive air pressure $P_2$ generated by the ignition of charge 268 can be directed through second aperture 264, facilitating the ejection of container 250 from extension 210. The used container can then be discarded, while body 202 can be reused in conjunction with a new container.

FIGS. 3*a*-3*d* and 6*a*-6*b* show another exemplary embodiment of a device for scattering confetti 300. Device 300 can include a body 302, at least one retaining structure 400, and a container 380 removably coupled to body 302. At least one retaining structure 380 may be coupled to body 302 or may be formed integral with body 302. Body 302, retaining structures 380, and container 380 may be formed from, as a non-limiting examples, plastic, metal, or any other material that enables device 300 to function as described herein. In some embodiments, body 302, retaining structures 400, and container 380 may be formed from two complementary halves that can be joined together to form body 302. Device 300 may further include any desired surface covering and may include any desired ornamentation or indicia disposed on the surface thereof. Furthermore, device 300 may be formed in any desired shape and may have decorative elements formed integral therewith, while retaining the functionality of device 300 as described herein.

Body 302 may have an elongated shape, an outer wall 304 enclosing a cavity 500, and may include a bend 306 in a portion of its length. Cavity 500 may further have a circular cross-section, an elliptical cross-section, or any desired cross-section that enables device 300 to function as described herein. Body 302 may include a distal end 308 having an aperture 312 defined therein, and a closed proximal end 310. Furthermore, as used herein, the term "longitudinal axis of body 302" should be understood to include only the portion of body 302 between proximal end 308 and bend 306.

Defined in the outer wall 304 of body 302 may be first opening 314 and second opening 324. Openings 314, 324 can be in communication with cavity 500 and the exterior of body 302. First opening 314 may have a longitudinal portion 316 having a distal end 318 and a proximal end 320 and extending substantially lengthwise along body 302, and a transverse portion 322 located at proximal end 320 and extending substantially circumferentially along body 302. Similarly, second opening 324 may have a longitudinal portion 326 having a distal end 328 and a proximal end 330 and extending substantially lengthwise along body 302, and a transverse portion 332 located at proximal end 330 and extending substantially circumferentially along body 302.

Disposed substantially proximate distal end 308 of body 302 may be a retention structure 400*a*, which may be, for example, a finger rest 402. Disposed substantially near proximal end 310 of body 302 may be a retention structure 400*b*, which may be, for example, a palm rest 420. Retention structures 400 may be coupled to body 302 or may be integrally formed with body 302.

Body 302 can further include trigger coupling structures 334 for pivotably coupling a trigger 340 to body 302. Trigger coupling structures 334 may be male structures such as pins or tabs, female structures such as recesses, or any other structure that allows device 300 to function as described herein. A stopper 336 may be provided on body 302 for engaging a portion of trigger 340, so as to limit the movement of trigger 340 or to define a furthest limit for the movement of trigger 340.

Figure 4A:
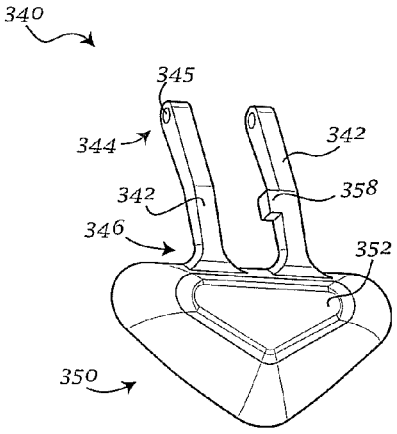
FIGS. 4*a*-4*b* show an exemplary trigger for a device for scattering confetti.
Figure 4B:
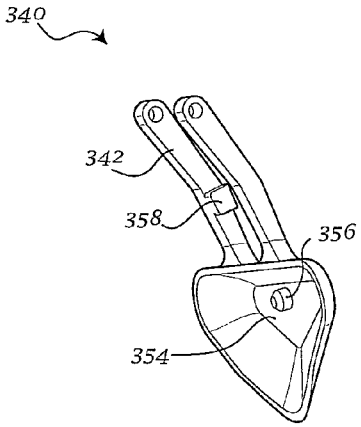

FIGS. 4*a*-4-*b* show a detail of trigger 340. Trigger 340 may include at least one arm 342 having a first end 344 and a second end 346. First end 344 may include body coupling structures 345 for pivotably coupling trigger 340 to body 302 by engaging trigger coupling structures 334. Body coupling structures may be female structures such as recesses, male structures such as pins or tabs, or any other structure that allows device 300 to function as described herein. A pad 350 may be disposed at the second end 346 of arm 342. Pad 350 may have any desired shape, for example a triangular shape, a triangular with rounded corners shape, a heart shape, and so forth. Pad 350 may have an engagement surface 352 which may be convex, and a spring engaging surface 354, which may include a first spring mounting structure 356 for retaining a resilient member 338, for example a spring. Resilient member 338 may be provided between pad 350 and palm rest 420 to facilitate returning trigger 340 to its furthest limit of movement after trigger 340 has been depressed, for example by pressing on engagement surface 352.

Arm 342 of trigger 340 may include a trigger tab 358 disposed thereon. Trigger tab 358 may protrude from arm 342, and may extend towards body 302 when the trigger is mounted on the body. If trigger 340 includes more than one arm 342, trigger tab 358 can be disposed on one of the arms 342.

Figure 5A:
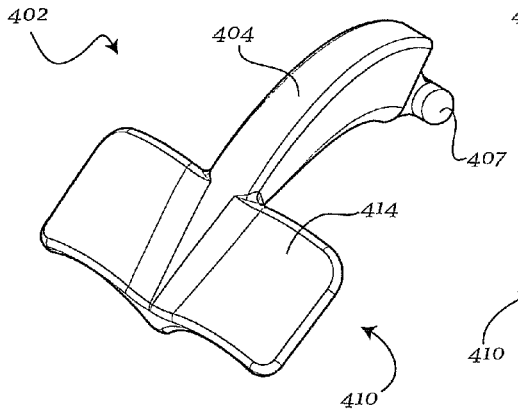
FIGS. 5*a*-5*b* show an exemplary finger rest for a device for scattering confetti.
Figure 5B:
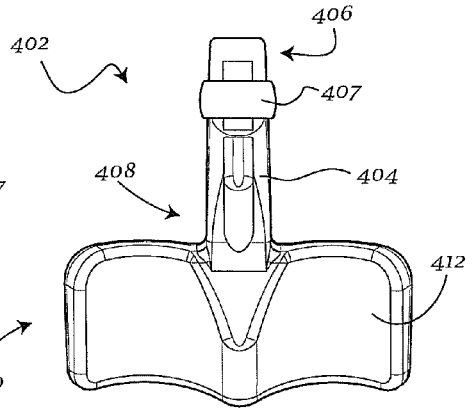

A detail of finger rest 402 may be shown in FIGS. 5*a*-5*b*. The finger rest can include a stem 404 having a first end 406 and a second end 408. In some embodiments, first end 406 may include coupling structures 407 for coupling finger rest 402 to body 302. Stem 404 may have an arcuate shape such that, when finger rest 402 is coupled to body 302, a convexly curved side of stem 404 is disposed facing away from body 302, a concavely curved side of stem 404 is disposed facing toward body 302, and second end 408 of stem 404 is in closer proximity to proximal end 310 of body 302 than the first end 406 of stem 404. Second end 408 can include a finger pad 410 extending laterally from stem 404. Finger pad 410 may have a finger engaging face 412 and an outward face 414. Finger pad 410 may have any desired contour, for example, rectangular, oval, or a decorative shape, and may have decorative indicia thereon, for example on outward face 414. Finger pad 410 may have a longitudinal axis which may be perpendicular to the longitudinal axis of stem 404. Finger engaging face 412 may be a doubly arched surface, which can facilitate comfortably engaging the middle and ring fingers of the user when device 302 is placed in the hand.

Palm rest 420 can be substantially planar, and can extend away substantially from proximal end 310 of body 302 such that an axis of palm rest 420 can be substantially parallel to the longitudinal axis of body 302 and such that a palm engaging face 422 of palm rest 420 is positioned facing finger engaging face 412 of finger pad 410. A spring-engaging face 424 of palm rest 420 may include a second spring mounting structure 426 for retaining resilient member 338. Palm rest 420 may have a shape that facilitates comfortably fitting palm rest 420 in the palm of a user, for example, a triangular shape, a triangular with rounded corners shape, a heart shape, or any such shape that allows device 300 to function as described herein.

Figure 6A:
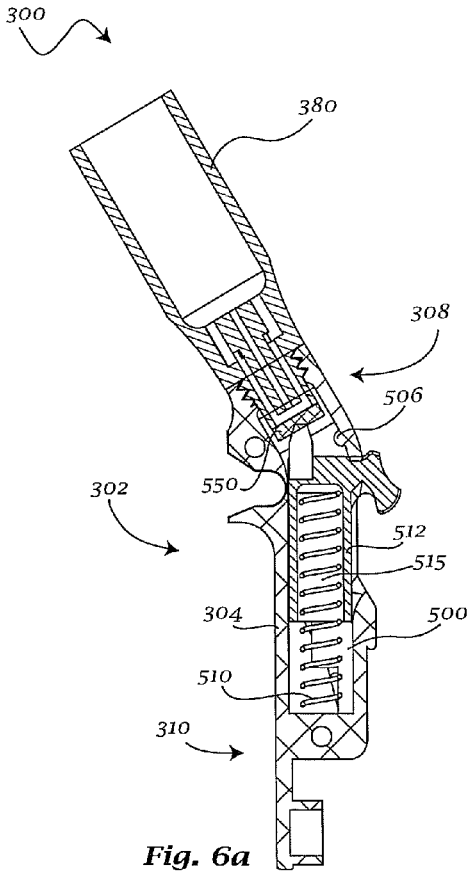
FIGS. 6*a*-6*b* show interior views of a third exemplary embodiment of a device for scattering confetti.
Figure 6B:
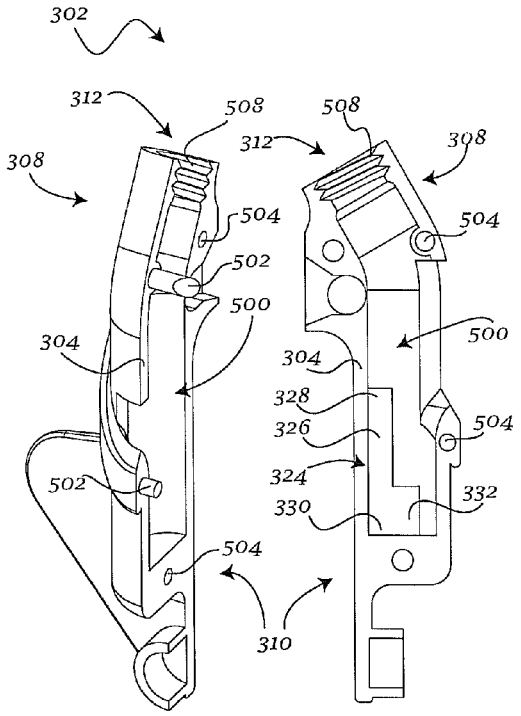
Figure 7A:
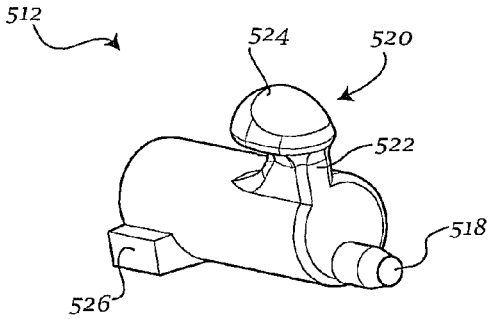
FIGS. 7*a*-7*b* show an exemplary piston for a device for scattering confetti.
Figure 7B:
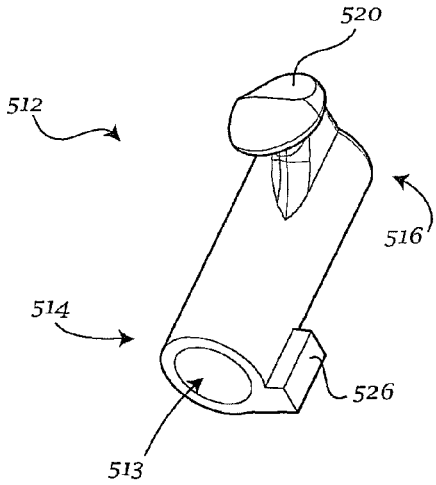

FIGS. 6*a*-6*b* are exemplary cutaway views of body 302 showing cavity 500. In some embodiments, wherein body 302 is formed from two halves, body 302 may include coupling structures such as pins 502 on one half that may couple to sleeves 504 on the other half. Body 302 may further include sleeves 504 for receiving fasteners such as screws for coupling the halves together. Disposed within cavity 500 and substantially proximate bend 306 may be stoppers 506. In some embodiments, pins 502 and sleeves 504 may function as stoppers 506.

Located substantially at distal end 308 and proximate aperture 312 may be container coupling members 508, which may be grooves, threads, tabs, indentations, lips, indentations, or any other coupling member that enables device 300 to function as described herein. Container coupling members 508 may be adapted to engage complementary coupling members 386 on container 380.

Disposed within cavity 500 and abutting proximal end 310 may be firing spring 510. Firing spring 510 may be a spring or any other resilient member that allows device 300 to function as described herein. Disposed between spring 510 and distal end 308 may be a piston 512, a detail of which may be shown in FIGS. 7*a*-7*b*. Piston 512 may have a proximal end 514 and a distal end 516, and may have a length shorter than the distance between proximal end 310 and stoppers 506, thereby allowing piston 512 to move longitudinally within cavity 500. Piston 512 may have diameter that is slightly smaller than the diameter of cavity 500, allowing for piston 512 to move within cavity 500 with minimal friction, as well as to rotate about its longitudinal axis.

Piston 512 may include an aperture 513 defined in the proximal end 514 of piston 512, and a cavity 515, which may be sized to receive spring 510. Piston 512 may include a pin 518 disposed at the distal end 516 thereof. Pin 518 may have a length such that, when piston 512 is abutting stoppers 506, pin 518 can protrude beyond stoppers 506.

Piston 512 may further include a reset tab 520 and a firing tab 526. Reset tab may be disposed substantially near distal end 516 of piston 512. Reset tab 520 may have a head 522 connected to a stem 524, the stem 524 being connected to piston 512 and sized to be received within first opening 314 of body 302. Head 522 may be disposed external to body 302 and can provide a surface that may be engaged and manipulated by the user, for example with the user's finger. Firing tab 526 may be disposed substantially near proximal end 514 of piston 512. Firing 526 tab may be sized to be received within second opening 324 of body 302 and may be engaged by trigger tab 358 of an arm 342 of trigger 340.

Figure 8A:
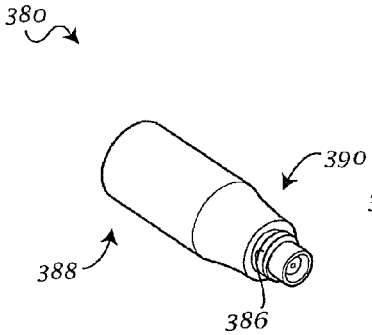
FIGS. 8*a*-8*c* show an exemplary confetti container for a device for scattering confetti.
Figure 8B:
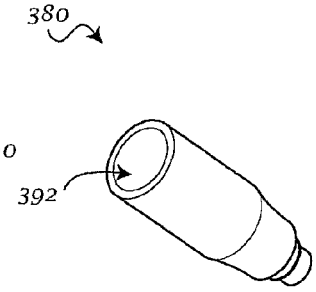
Figure 8C:
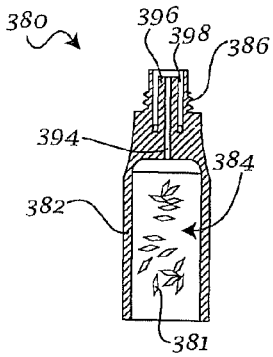

Turning to FIGS. 8*a*-8*c*, container 380 may have an elongated shape and an outer wall 382 enclosing a cavity 384. Container 380 may include a distal end 388 having an aperture 392 defined therein, and a proximal end 390. A portion of container 380 may taper towards proximal end 390. Proximal end 390 may include complementary coupling members 386, which may be grooves, threads, tabs, indentations, lips, indentations, or any other coupling member that enables device 300 to function as described herein. Complementary coupling members 386 may be adapted to engage container coupling members 508 of body 302.

Also located at proximal end 390 of container 380 may be an inner cylinder 396 having a bore 394 defined therethrough. Inner cylinder 396 may be separated from coupling members 386 by an annular groove 398. Bore 394 may be in fluid communication with cavity 384 of cylinder 380 and the environment external to cylinder 380.

As shown in FIG. 6*a*, a detonative charge 550 may be coupled to the proximal end 390 of container 380 such that charge 550 is disposed over proximal end 390, including bore 394. Charge 550 may be, but is not limited to, a percussion cap such as that used for cap guns, a cartridge containing a propellant gas such as $CO_2$, a propellant powder, or impact-sensitive silver fulminate (AgONC). Furthermore, the charge may include a composition that is compliant with United Nations Organization Hazard Class and Division code 1.4S, or any corresponding or equivalent national hazardous material classifications.

The diameter of proximal end 390 of container 380 may be substantially similar to the diameter of distal end 308 of body 302, such that coupling container 380 to body 302 produces a flush fit between the container and the body. Container coupling members 508 of body 302 and complementary coupling members 386 of container 380 can couple so as to form a secure coupling that can withstand the detonation force of charge 550. When container 380 is coupled to body 302, charge 550 may be disposed between container 380 and stoppers 506 that are disposed in cavity 500.

Confetti 381 may be disposed within cavity 384 of container 380. To retain the confetti within container 380, a cap may be removably coupled to container 380 proximate aperture 392. The cap may be foamed from paper, cardboard, tissue material, foam, or any other desired material that enables device 300 to function as described herein. Furthermore, disposed between confetti 381 and proximal end 390 of container 380 may be a separator. The separator can reduce the likelihood of confetti 381 igniting upon combustion of charge 550 and can further facilitate expelling confetti 381 from container 380. The separator may have a planar shape substantially similar to the cross-section of formed from a lightweight, tough material that can withstand the explosive force of charge 550 without breaking. As a non-limiting example, such materials may include cardboard, heavy paper, plastic, foam, or any other desired material that enables device 300 to function as described herein.

Figure 9A:
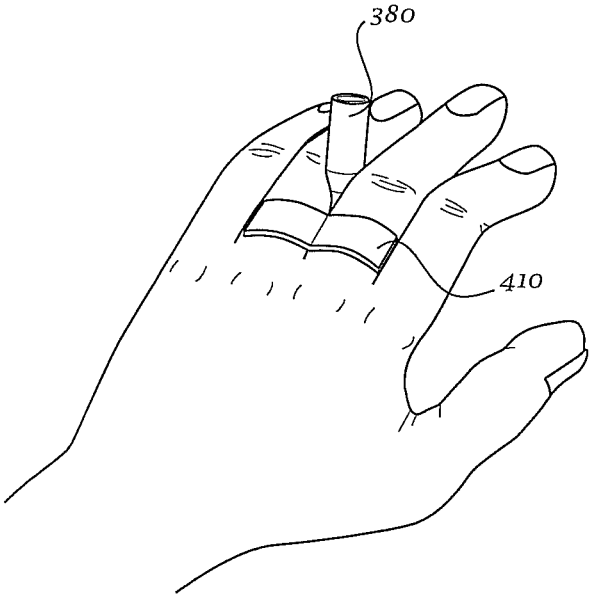
FIGS. 9*a*-9*b* show an exemplary embodiment of a device for scattering confetti attached to a user's hand.
Figure 9B:
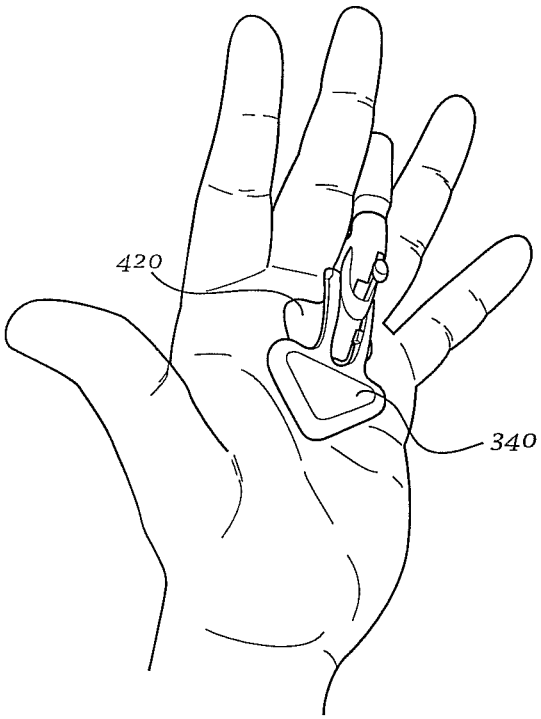

The use and operation of the device for scattering confetti 300 may now be described. As shown in FIGS. 9*a*-9*b*, when confetti scattering device 300 is placed in the hand of a user, palm rest 420 can be disposed in the palm of the hand, while stem 404 of finger rest 402 can extend between the middle and ring fingers of the hand, and finger pad 410 can engage the backs of the middle and ring fingers. Trigger 340 can be disposed outward from the palm of the hand and palm rest 420, and may be positioned at its furthest limit. When the fingers of the hand are fully extended, the portion of body 302 between proximal end 310 and bend 306 can extend substantially parallel to the fingers, while the portion of the body between bend 306 and distal end 308 can extend between the middle finger and ring finger. The angle of the portion of the body between bend 306 and distal end 308 may be such that when device 300 is disposed in a user's hand and the user's fingers are fully extended, an acute angle exists between distal end 308 and the tips of the fingers. Such an angle facilitates directing the confetti 381 upward and rearward in relation to the user's hand when the user's hand is in a substantially vertical orientation, such as, for example, the orientation typically used for a "high five" gesture.

Device 300 can be in a "safe" mode, as described below. When device 300 is in the "safe" mode, container 380 may be coupled to the device. Subsequent to coupling the container, and when desired by the user, device 300 may be reset into the "loaded" mode, in which device 300 can be ready to fire and eject confetti 381 from cylinder 380.

When piston 512 is in a distal position, reset tab 520 may be disposed at distal end 318 of longitudinal portion 316 of first opening 314, and firing tab 526 may be disposed at distal end 328 of longitudinal portion 326 of second opening 324. In the distal position, piston 512 abuts stoppers 506, and device 300 may be considered to be in the "safe" mode, wherein depressing trigger 340 has no effect, even if a cylinder 380 is coupled to body 300. To reset device 300 into the "loaded" mode, the user may engage head 522 of reset tab 520 and move tab 520 towards the proximal end 320 of longitudinal portion 316 of first opening 312. The user may then move reset tab 520 laterally into transverse portion 322 of first opening 314, which can rotate piston 512 and can move firing tab 526 from the proximal end 330 of longitudinal portion 326 of second opening 324 into transverse portion 332 of second opening 324. As firing spring 510 is now compressed, the force of firing spring 510 pushes tabs 520, 526 against the walls of the transverse portions of their respective openings 314, 324, thereby impeding movement of piston 512 from the proximal position.

To "fire" device 300, the user may depress trigger 340 such that trigger tab 358 of arm 342 engages firing tab 526 of piston 512 and moves firing tab 526 from transverse portion 332 of second opening 324 into longitudinal portion 326 of the second opening. As a result, the movement of piston 512 is no longer impeded by the engagement of tabs 520, 526 with the walls of openings 314, 324, and the decompressing spring can rapidly move piston 512 towards the distal position. While movement of piston 512 is impeded by stoppers 506, pin 518 disposed at distal end 516 of piston 512 can have a length that allows pin 518 to protrude sufficiently beyond stoppers 506 so as to strike charge 550, detonating the charge. Alternatively, the movement of piston 512 may be impeded by the wall of the distal end 328 of first opening 514 engaging reset tab 520. Similarly, when piston 512 is in the distal position, pin 518 can have a length that allows the pin to extend sufficiently so as to strike charge 550, detonating the charge.

The positive air pressure generated by the ignition of charge 550 can be directed through bore 394 of cylinder 380, toward the separator, confetti 381, and the cap. The cap can thus decouple from aperture 392 of container 380 and the confetti can be ejected through aperture 392. The empty container 380 can now be decoupled from body 302 and discarded, while body 302 can be reused in conjunction with a new container.

FIGS. 10*a*-10*e* show exemplary embodiments of a glove or band having a device for scattering confetti. The glove or band may be formed from any desired material, including, but not limited to, nylon, spandex, lycra, leather, synthetic leather, and the like, and may have portions formed from diverse materials. The device for scattering confetti for use with the glove or band may have a configuration according to any of the embodiments of the device disclosed herein, or may have a different configuration. Certain constituent members of the device for scattering confetti may be replaced with analogous constituent members adapted for the glove or band; however, it should be understood that the functionality of the device can be substantially as disclosed herein.

Figure 10A:
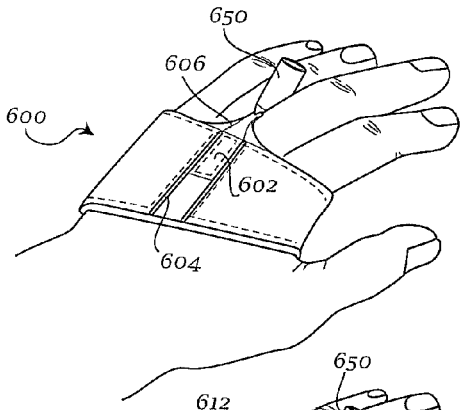
FIGS. 10*a*-10*e* show exemplary embodiments of hand apparel for use with a device for scattering confetti.

FIG. 10*a* shows a back hand view of an exemplary embodiment of a band 600 for use with a device for scattering confetti 650. Band 600 may be resilient and may wrap around the hand of a user, substantially around the palm, above the thumb, and below the fingers. Band 600 may include a pocket 602 located substantially at the back of the hand and below the middle and ring fingers. In this embodiment, device 650 can include a back hand rest in lieu of a finger rest. The back hand rest can be sewn into the band 600 or the pocket 602. Piping 604 and other decorative indicia may also be disposed on band 600. A loop of material 606, or a similar structure may extend from band 600 towards device 650 and may encircle a portion of device 650.

Figure 10B:
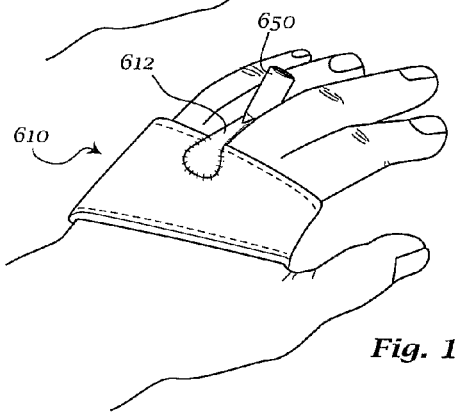

FIG. 10*b* shows a back hand view of another exemplary embodiment of a band 610 for use with a device for scattering confetti 650. Band 610 may be resilient and may wrap around the hand of a user, substantially around the palm, above the thumb, and below the fingers. In this embodiment, the finger rest of device 650 may be removed. A loop of material 612, or a similar structure may extend from band 610 towards device 650 and may encircle a portion of device 610.

Figure 10C:
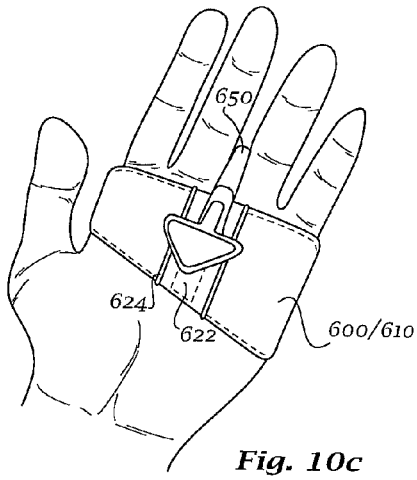

FIG. 10*c* shows the palm view of the exemplary embodiment of band 600 or the exemplary embodiment of band 610. Band 600/610 may include a pocket 622 located substantially at the palm of the hand, wherein a palm rest of the device 650 can be disposed. In some embodiments, the palm rest may be sewn into the band or the pocket such that device 650 is not separable from band 600/610. Piping 624 and other decorative indicia may also be disposed on band 600/610.

Figure 10D:
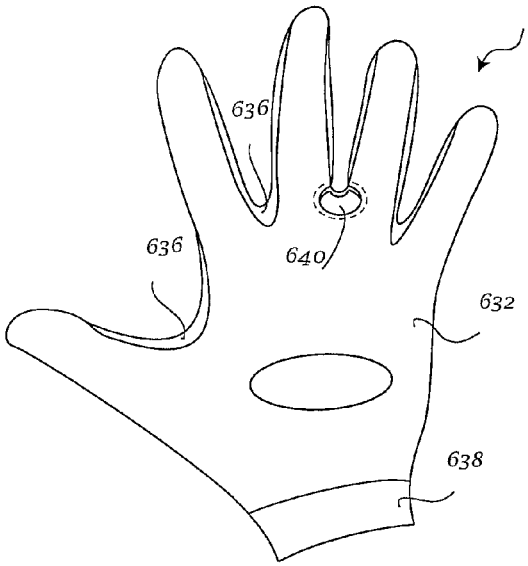
Figure 10E:
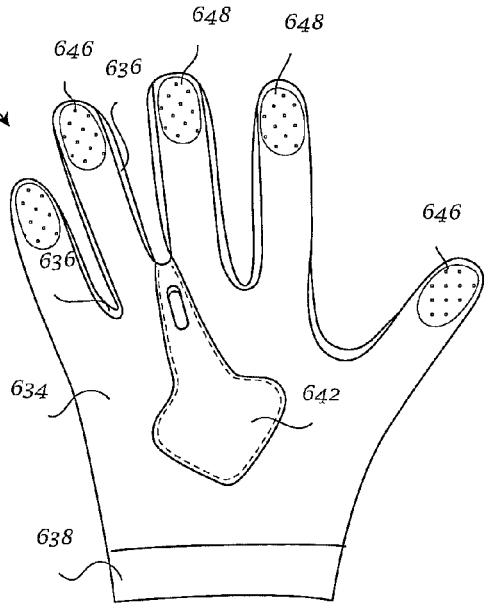

FIGS. 10*d*-10*e* show an exemplary embodiment of a glove 630 for use with a device for scattering confetti 650. The back 632 and palm 634 portions of the glove may be made, for example from spandex, while the fourchette portions 636 of the glove may be made, for example, from lycra. A wrist cuff 638 may be made, for example, from neoprene. The back portion 632 of the glove may include decorative or logo indicia thereon. An aperture 640 may be disposed between the middle and ring fingers and at the base of the fingers. Aperture 640 may be reinforced and may be sized to receive a portion of the body of a confetti scattering device. The palm portion 634 of the glove may include a pocket 642 in which a portion of the device may be disposed. The pocket may be made, for example, from a durable material such as synthetic leather. The portion of the device that is disposed within pocket 642 may one or more of the palm rest, the body, and the trigger of device 650. Pocket 642 may include an aperture 644 for receiving a portion of the confetti scattering device, for example the stem of the trigger of the device. Additionally, the fingers of glove 630 may include perforations 646 and grip pads 648, which may be made of, for example, silicone.

The embodiments of the confetti scattering devices, and the gloves and bands for use therewith that are disclosed herein can thus provide a novel, entertaining, and safe way for individuals to enhance their parties and celebrations with confetti, and to incorporate the element of confetti into popular celebratory gestures. It should be appreciated that the device for scattering confetti is not limited for use with the "high-five" and may be used with any gesture involving pressure to the palm of the hand, regardless of whether the gesture involves one, two, or multiple people.

Confetti for use with the embodiments of the devices, gloves and bands disclosed herein may be any known confetti. For example, the confetti may be made from paper, cardboard, biodegradable materials, tissue paper, and may be multicolored, reflective, glow-in-the-dark, or may have any other known decorative features. The confetti may further include glitter or any other similar composition. The confetti may have a size of approximately 1 mm square, or any size that enables the devices, gloves and bands to function as disclosed herein.

Containers disclosed herein may be formed, for example, by injection molding or plastic extrusion, and may be manually or automatically filled with confetti and may further be provided with separators and charges, if necessary for a particular embodiment. Portions such as air bladders, may be formed, for example, by blow molding. Other portions of the bodies and other constituent members may be formed for example, by injection molding or plastic extrusion. Certain members, such as, for example, the pin of the piston, may be made from metal so as to increase durability and resistance to damage from repeated detonations of the charge. The various constituent members of the devices may be bonded together, for example, via adhesive or thermal bonding, via fasteners such as screws, or may fit together via friction fit. Other methods of manufacturing the constituent members of the devices, other materials for forming the devices, and other methods of bonding the devices may be contemplated and provided as desired without departing from the spirit of the invention.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A device for scattering confetti, comprising:

a body including a cavity having a proximal end and a distal end;

a container, coupled to the body, and having confetti disposed therein; and at least one retaining structure for maintaining the device in a hand of a person;

wherein a portion of the body is disposed in the palm of the hand; and wherein one or both of the body and the container comprise at least one component for releasing confetti from the container, such that an actuation of the at least one component releases the confetti; and the at least one component for releasing confetti comprises a piston disposed in the cavity and moveable between the proximal end and the distal end of the cavity, a detonative charge, a resilient member disposed within the cavity between the piston and the detonative charge and exerting a force on the piston toward the proximal end, and a pin extending from the piston and at least partially through the resilient member toward the detonative charge.

2. The device of claim 1, wherein a portion of the body or a portion of the container is disposed between the middle finger and index finger of the hand.

3. The device of claim 1, wherein:

when the container is coupled to the body, the detonative charge is disposed between the piston and the confetti.

4. The device of claim 1, wherein the piston is disposed so as to engage the detonative charge.

5. The device of claim 1, wherein the at least one retaining structure comprises a strap, a band, or a glove.

6. A device for scattering confetti, comprising:

a body;

a cavity defined within the body, and having a proximal end and a distal end;

a piston disposed in the cavity and moveable between the proximal end of the cavity and the distal end of the cavity;

a container removably coupled to the body and having confetti disposed therein;

a detonative charge, disposed between the piston and the confetti;

at least one retaining structure for maintaining the device in a hand of a person;

at least one opening having a transverse portion and a longitudinal portion defined in an outer wall of the body between the proximal end and the distal end, the opening being in communication with the cavity and the exterior of the body; and at least one rigid tab coupled to the piston and received within the opening, wherein the piston is in a first position at the proximal end of the cavity when the at least one rigid tab is received within the transverse portion of the opening, and moveable to a second position at the distal end of the cavity when the at least rigid one tab is within the longitudinal portion of the opening.

7. The device of claim 6, further comprising a trigger, wherein a movement of the trigger engages the at least one rigid tab and moves the at least one tab from the transverse portion of the opening to the longitudinal portion of the opening which results in a movement of the piston.

8. The device of claim 6, wherein the movement of the piston results in detonation of the charge.

9. The device of claim 6, wherein the body further comprises a bend in a portion of its length.

10. The device of claim 6, further comprising a resilient member disposed between the proximal end of the cavity and the piston, wherein the resilient member exerts a force on the piston in the direction of the distal end of the cavity.

11. The device of claim 6, wherein:

the piston is adapted to be releasably retained at the proximal end of the cavity.

12. The device of claim 6, wherein the at least one tab is operable by the user so as to move the piston.

13. The device of claim 6, wherein the at least one retaining structure comprises a strap, a band, or a glove.

* * * * *